US005257742A

United States Patent [19]

Yashima et al.

[11] Patent Number: 5,257,742

[45] Date of Patent: Nov. 2, 1993

[54] ULTRAFINE GRINDING MILL OF WHICH FED MATERIAL FLOWS DOWN THROUGH AN AGITATED BED COMPOSED OF SMALL GRINDING MEDIUM

[75] Inventors: Saburoh Yashima, Sendai; Sadayuki Naitoh; Hiroyuki Takahashi, both of Souma; Manabu Abe, Miyagi, all of Japan

[73] Assignee: Fimatec Ltd., Tokyo, Japan

[21] Appl. No.: 877,102

[22] Filed: May 1, 1992

[30] Foreign Application Priority Data

May 8, 1991 [JP] Japan ..... 3-102828

[51] Int. Cl.[5] ..... B02C 17/16

[52] U.S. Cl. ..... 241/65; 241/172; 241/184

[58] Field of Search ..... 241/171, 172, 184, 65, 241/69

[56] References Cited

U.S. PATENT DOCUMENTS

| | | | |
|---|---|---|---|
| 3,329,348 | 7/1967 | Pootmans | 241/172 |
| 3,337,140 | 8/1967 | Wahl | 241/172 |
| 3,676,963 | 7/1972 | Rice et al. | 241/184 |
| 3,944,145 | 3/1976 | Eichholz et al. | 241/172 |
| 3,993,254 | 11/1976 | Bicik et al. | 241/172 |
| 4,225,092 | 9/1980 | Matter et al. | 241/172 |
| 4,511,092 | 4/1985 | North et al. | 241/172 |
| 5,007,589 | 4/1991 | Evans et al. | 241/172 |

*Primary Examiner*—Scott Smith

*Attorney, Agent, or Firm*—Mason, Fenwick & Lawrence

[57] ABSTRACT

An ultrafine grinding mill in which fed material flows down through an agitated bed composed of small grinding medium characterized in that the ultrafine grinding mill comprises a vertically arranged cylindrical housing, a net member having a mesh size preventing the grinding medium from passing therethrough and arranged at the bottom of the cylindrical housing, a rotary shaft arranged on a central axis of the cylindrical housing, and agitating blades mounted at several stages on the rotary shaft, and in that both a gap between the tip of each agitating blade and the inner surface of the cylindrical housing and a gap between the agitating blade of the lowermost stage and the net member are not more than $\frac{2}{3}$ the diameter of the grinding medium at room temperature.

9 Claims, 10 Drawing Sheets

Particle size distribution of ultrafine ground product and classified ground product of limestone—1A, 2A and 8A in Tables 1 and 2

Particle size distribution of ultrafine ground product and classified ground product of limestone—1A.3A and 9A in Tables 1 and 2

Particle size distribution of ultrafine ground product of limestone—1A, 4A and 5A in Tables 1 and 2

Particle size distribution of ultrafine ground product of limestone when cooled grinding chamber −2B and 5B in Table 3

Effect of grinding aid in ultrafine grinding product of limestone

Particle size distribution of ultrafine ground product of talc under several grinding conditions-1C, 6B, 6C and 7C in Tables 3 and 5

Particle size distribution of ultrafine ground product of kaolin

ULTRAFINE GRINDING MILL OF WHICH FED MATERIAL FLOWS DOWN THROUGH AN AGITATED BED COMPOSED OF SMALL GRINDING MEDIUM

BACKGROUND OF THE INVENTION

The present invention relates to an ultrafine grinding mill of which fed material (raw material to be ground) flows down through an agitated bed composed of small grinding medium and more particularly to such an ultrafine grinding mill which can produce spherical ultrafine particles each having a diameter less than about 2 μm by a dry process. Such spherical ultrafine particle of a diameter less than 2 μm is usually used, from its configuration characteristics, for packing material, coating material for papermaking, pigment, filler and other materials required for an interfacial control of high accuracy.

It is known in prior art several kinds of ultrafine grinding mills such as a mill having a hummer or rotor of high rate of revolution whose fed material is ground by impact and shearing, a ball mill whose fed material is ground by mutual collision between balls, a jet grinding mill whose fed material is ground by mutual collision between jet flows including fed material, and a medium agitation mill in which a mixture of fed material and grinding medium is agitated and ground by abrasion. In these ultrafine grinding mills, the medium agitation mill is adapted to produce ultrafine particles by mutual abrasion between grinding medium particles and fed material particles and is suited for forming powder of submicron range in which the plastic breakage is at advantage over the elastic breakage.

In prior art ultrafine grinding mills of dry type, any mill causes both a grinding action of raw material to be ground (fed material) and an agglomerating phenomenon what is called negative grinding, due to the recombination of ground product (material formed by grinding) within a mill. Accordingly the particle size of fineness limit (i.e. grinding limit achieved by grinding) is determined by an equilibrium state between the grinding rate and the agglomerating rate. This agglomerating phenomenon is particularly remarkable in the ball mill, the vibration ball mill and the planetary mill in which the fed material is ground by the impact action of the grinding medium. The grinding medium, on the one hand, accelerates the grinding of the fed material and on the other hand, accelerates the agglomerating phenomenon due to the pressure adhesion of newly ground product.

In order to quickly discharge the ground product from the grinding mill so as to prevent the agglomerating phenomenon, there has been used a method of a type "airflow discharge/separetely installed classifier" and there has been proposed a grinding mill of a type "airflow discharge/built-in classifier". However it is difficult to perfectly disperse a group of ground particle products having a max. particle size (i.e. a top size) of few μm's due to influences of moisture or static electricity and also it is difficult to apply said method and grinding mill for ultrafine grinding because the action based upon the settling velocity and body force (volume force) in an airflow of particles contributing to the classifying action drastically decreases in proportion to (particle size) $^{-3}$.

SUMMARY OF THE INVENTION

It is therefore an object of the present invention to provide an ultrafine grinding mill which can prevent the ground particle products each having a surface rich in activity from residing long time in the grinding mill and also can reduce or eliminate the chance of generation of agglomeration due to the collision of the grinding medium to efficiently perform the grinding operation.

It is another object of the present invention to provide an ultrafine grinding mill of which fed material flows down through an agitated bed composed of small grinding medium which can produce ground particle products each particle being spherical and not having any sharp corner or projection.

According to the present invention there is provided an ultrafine grinding mill of which fed material flows down through an agitated bed composed of small grinding medium characterized in that said ultrafine grinding mill comprises a vertically arranged cylindrical housing, a net member having a mesh size preventing the grinding medium from passing therethrough and arranged at the bottom of the cylindrical housing, a rotary shaft arranged on a central axis of the cylindrical housing, and agitating blades mounted at several stages on the rotary shaft, and in that both a gap between the tip of each agitating blade and the inner surface of the cylindrical housing and a gap between the agitating blade of the lowermost stage and the net member are in a range $\frac{2}{3}$ through 0 of the diameter of the grinding medium at room temperature.

BRIEF DESCRIPTION OF THE DRAWINGS

Other objects and advantages of the present invention will become apparent from the following detailed description of a preferred embodiment of the present invention taken in reference to the accompanying drawings in which.

DESCRIPTION OF THE PREFERRED EMBODIMENT

Figure 1:
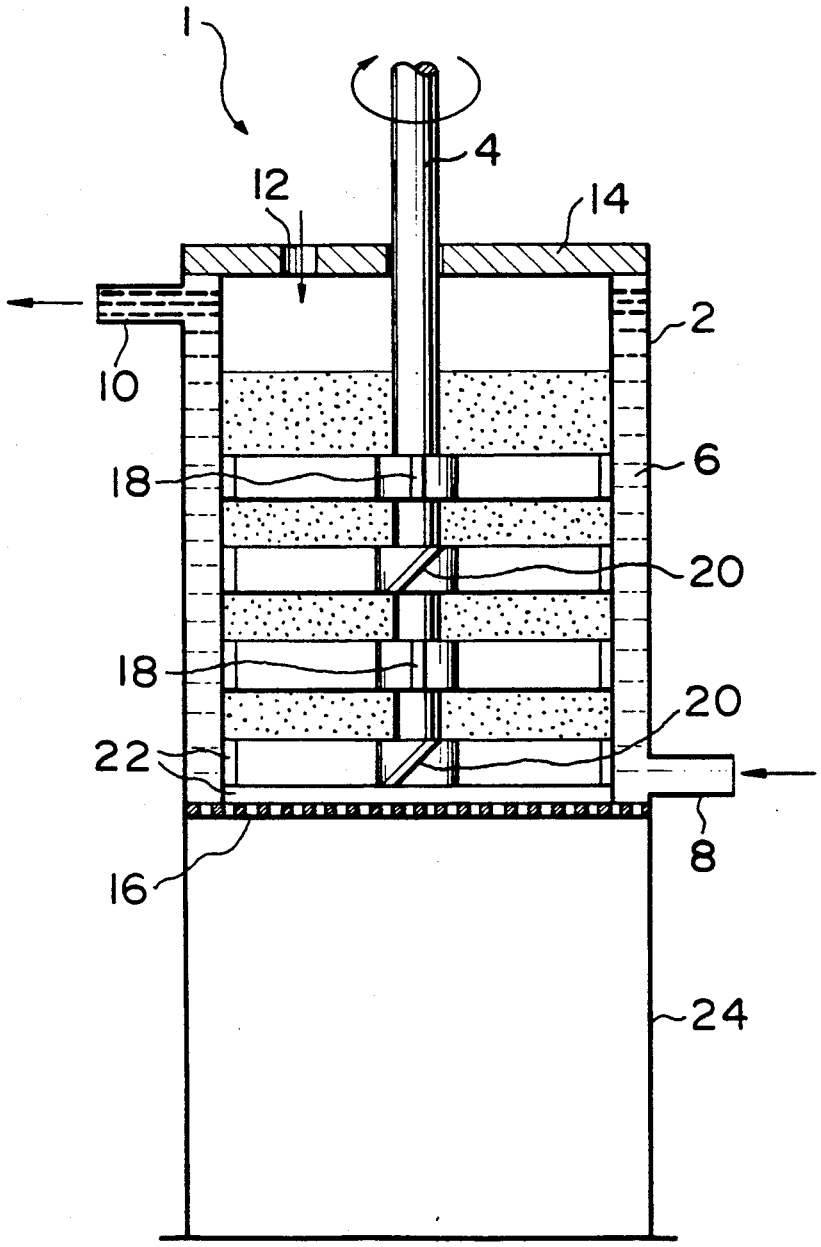
FIG. 1 is a cross-sectional view of the ultrafine grinding mill of the present invention.

A preferred embodiment of the ultrafine grinding mill of which fed material flows down through an agitated bed composed of small grinding medium of the present invention (hereinafter simply referred to as "the ultrafine grinding mill of the invention") will be hereinafter described with reference to the accompanying drawings. As shown in FIG. 1, the ultrafine grinding mill 1 of the invention is provided with a vertically arranged cylindrical housing 2 in which a rotary shaft 4 is positioned at a central axis of the housing 2. The housing 2 has a double-walled structure so that cooling water 6 supplied from an inlet pipe 8 is circulated through between the walls of the housing 2 and finally discharged from an outlet pipe 10.

A top of the cylindrical housing 2 is covered by a lid member 14 having a port 12 for supplying fed material (i.e. material to be ground) into the housing 2. A bottom of the housing 2 is provided with a net member or a stainless steel screen 16 having a mesh size preventing grinding medium used together with the fed material from passing therethrough.

Mounted on the rotary shaft 4 within the housing 2 are a plurality of vertical agitating blades 18 and a plurality of slanted agitating blades 20 which are arranged in four stages on the rotary shaft 4 in the illusted embodiment. Each of the vertical agitating blades 20 is vertically arranged on the rotary shaft 4 so that it is oriented parallel to the central axis of the cylindrical housing 2 and each of the slanted agitating blades is arranged on the shaft 4 so that it is inclined relative to the central axis of the housing 20. In the illusted embodiment, the first and third stages from the top are formed by the vertical agitating blades 18. Arranged in each stage are four vertical agitating blades 18 which radially extend from the shaft 4 and which are spaced apart at 90° intervals. The second and fourth stages are formed by the slanted agitating blades 20. Arranged in each stage are four slanted agitating blades 20 which radially extend from the shaft 4 and which are spaced apart at 90° intervals.

The height of the vertical blades 18 and the slanted blades 20 is substantially same and the space between the vertical blades 18 and the slanted blades 20 is substantially the same as the height of the agitating blades 18 and 20. Preferably the tip of each blade 18 and 20 is formed by a flexible member such as a heat resisting rubber member 22. The distance or gap between the tip of each of the blades 18 and 20 and the inner surface of the cylindrical housing 2 should not be more than $\frac{2}{3}$ the diameter of the grinding medium at room temperature in order to prevent the grinding medium from being clogged therebetween. In the experiments discussed below, the gap is selected as 0.5 mm. It is supposed that the tip of each blade 18 and 20 is substantially in contact with the inner surface of the housing 2 during the grinding operation due to the thermal expansion of the blades 18 and 20.

It is preferable to form the agitating blades 18 and 20 of the lowermost stage with the flexible member such as heat resisting rubber member 22 not only at their tips but also their bottom edges. The distance or gap between the bottom edge of each of the blades of the lowermost stage and the upper surface of the stainless steel screen 16 should be a range $\frac{2}{3}$ through 0 of the diameter of the grinding medium at room temperature. In the experiments discussed below the gap is selected to be 0.5 mm.

The cylindrical housing 2 is supported on a box 24 for receiving the ground product.

SPECIFICATION OF THE DEVICES USED IN THE EMBODIMENT

The dimensions of the structural elements forming the ultrafine grinding mill of the invention are as followings;

(1) Cylindrical housing 2—Inner diameter: 207 mm; Depth of inner surface: 235 mm; Inside volume: 7,981 $cm^3$.

(2) Stainless steel screen 16—Mesh size (max. opening): 0.3 mm.

(3) Agitating blades 18, 20—Diameter of a circle drawn by the tips of blades: 206 mm; Thickness: 35 mm. The rotational direction of the rotary shaft 4 is selected so that the slanted agitating blades 20 can raise the fed material and the grinding medium.

(4) Rotational speed—Good agitating state can be obtained at 400~500 rpm in the case of the grinding medium later mentioned. In this case the peripheral velocity of the tips of the agitating blades is 4.31~5.39 m/s.

(5) Heat resisting rubber member 22—Heat resisting temperature: about 300° C.; Thickness: 3 mm.

(6) Grinding medium—Small diameter alumina-ball; Ball diameter: 1 mm, 2 mm and 3 mm; Specific gravity: 3.60; Amount of charge: 9~10 kg; Load against the agitating blades: 15.6~17.4 $g/cm^2$; Zirconia-balls may be used in place of alumina-balls.

(7) Cooling water—City water of about 20° C.; Dry ice may be also added into the fed material and the grinding material if necessary.

(8) Instruments for measuring the particle size distribution of the fed material and the ground product PRO-7000S (manufactured by SEISIN KIGYOU) and SA-CP4L (manufactured by SHIMADZU SEISAKUSYO); Prior to measurement of the particle size distribution a sample was dispersed in the distilled water by using ultrasonic distributing apparatus "Sine Sonic 150" (manufactured by KOKOSAIDENKI ERUTEKKU) with sodium pyrophosphate and like as the dispersing agent.

(9) Instrument for Observating particle configuration Scanning electron microscope "JSM-T100" (manufactured by JEOL)

(10) Instruments for measuring temperature Thermolabel (manufactured by NITIYU GIKEN KOGYOU) and an alcohol thermometer

OPERATION

The cooling water 6 is supplied through the inlet pipe 8 into the space defined by the walls of the cylindrical housing 2 and is discharged from the outlet pipe 10 after a circulation through the space. The fed material and the grinding medium are supplied through the supplying port 12 and then the rotary shaft 4 is continuously rotated. While the fed material and the grinding medium are agitated within the housing 2, the fed material is ground by the grinding medium and only the ground product is finally dropped into the product receiving box 24 through the mesh of the stainless steel screen 16. If necessary, dry ice may be supplied together with the fed material and the grinding medium in order to control the grinding temperature within the housing 2.

TYPICAL CHARACTERISTICS OF THE INVENTION

The typical characteristics of the ultrafine grinding mill of the present invention will be described.

(1) Particle Size of the Fed Material

In the ultrafine grinding mill to which the present invention relates, although it is apt to be considered that the smaller the fed material, the smaller the ground, this is not true. This is because, in fed material in which the particles have large size, potential cracks causing the breakage of the particle reside deep in the particles, so that the total number of the cracks is larger in the larger particle and is easily broken. On the other hand, the smaller the particle, the smaller the total number of the potential cracks. Accordingly much work is required for ultrafine grinding a small particle (see Experiment 4).

(2) Control of the Particle Size of the Ground Product

In the ultrafine grinding mill of the present invention, the range of rotation for realizing the optimum agitating state for ultrafine grinding is not so wide and is limited in a relatively small range based upon the particle size and the amount of the grinding medium. Accordingly when the particle size of the fed material is constant, factors influencing the grinding process are considered to be the particle size of the grinding medium i.e. ball size), residence time in the grinding medium, and feeding rate of the fed material. In general the smaller the grinding medium, the longer the residence time, and the smaller the feeding rate of the fed material, the finer ground product can be obtained.

(3) Reason for Spheroidization of the Ground Product

In the case of hard materials such as glass, the breakage of a fragile solid particle exhibits an aspect of elastic breakage. On the other hand, in the case of relatively soft materials such as natural gypsum, talc and limestone/marble, the breakage is elastic breakage accompanied with plastic breakage. However what is stated above is relates to the aspects seen in a particle having a relatively large particle size. In any kind of rock sample, the crystalline structure is disarranged as the grinding progresses and thus the particle size is progressively reduced. It exhibits a breakage mingled with the elastic breakage and the plastic breakage when the particle size becomes about 8~10 μm. When the particle size becomes smaller, less than 2~3 μm, it perfectly exhibits the plastic breakage and becomes impossible to measure the breaking strength point.

The maximum particle size (top size) achieved by the ultrafine grinding mill of the present invention is about 2 μm. Considering the change of the breakage due to particle size mentioned above, it is believed that the spheroidization of the ground product will be achieved based upon continuous contacts between the fed material and the grinding medium as well as between the particles of the fed material themselves while the ultrafine ground product is changed to the plastic material which is in an agitated state, rather than due to a tipping effect.

The spheroidization of the ground product has been originally achieved in accordance with the present invention and it is considered that a very transient phenomenon has been caused in a short time in the grinding mill.

(4) Effect Due to the Grinding Aid

In the present invention, the ground product is immediately discharged from the ultrafine grinding mill due to its structural features when the product has been ground to a predetermined ultrafine particle size. Accordingly there is little agglomerating action causing firmly combined particles due to reagglomeration of the ground product and there is little impact action accelerating such an agglomerating action.

This means that the best ultrafine grinding can be achieved when no grinding aid is used and the smallest ultrafine particles can be obtained. The use of grinding aids such as calcium stearate (St. Ca), triethanolamine (TEA), polyethylene glycol-300 (PEG-300) can improve the dispersibility. However, since the velocity of the particles passing through the grinding medium in the agitated state becomes fast and the grinding force is not effectively transmitted due to slippage of the particles, the particle size of fineness limit achieved by grinding (i.e. grind limit) becomes larger than the case in which no grinding aid is used. The effect due to the grinding aid is different in these points from a usual grinding mill.

The degree of agglomeration is very weak such that it can be perfectly dispersed by only one treatment passing through an airflow type mill even if the ground product collected in the box 24 would exhibit weak agglomeration (see the experiments 1 and 3).

INFLUENCE OF TEMPERATURE

The fragile material such as rock exhibits so-called energy elasticity and does not exhibit entropy elasticity. The grinding effect is reduced by the forced cooling with supplying dry ice into the cylindrical housing 2 of the present invention. In consideration of the action mechanism of the grinding aids, it is believed that optimum temperature of the inner wall of the housing 2 cooled by water is 120°~130° C.. From the heat resistance of the structural members of the ultrafine grinding mill of the present invention, it is supposed that the highest temperature is 150°~200 ° C. (see Experiment 2).

FORMULATION OF GRINDING MEDIUMS OF DIFFERENT SIZE

For example, when mingling the alumina-balls each having a diameter of 1 mm 30 weight %) and alumina-balls each having a diameter of 3 mm 70 weight %) and then agitating them in the cylindrical housing 2, the lower part of the housing (i.e. grinding chamber) 2 is almost occupied by the alumina-balls of 1 mm diameter (Φ), the upper part of the housing 2 is almost occupied by the alumina-balls of 3 mm diameter and the central part of the housing 2 is occupied by the mixture of the alumina-balls of 1 mm and 3 mm diameters. This will be owing to the fact that since the larger the ball, the larger the inertial force, the balls of 3 mm diameter is moved stronger than the balls of 1 mm diameter and that since the charged structure in a stationary condition is destroyed by the agitation and moves in a condition in which the gaps between particles are enlarged, the balls of 1 mm diameter fall through the gaps and thus lift the balls of 3 mm diameter upward. Irrespective of the reason of which, the distribution of the balls stated above will be more or less obtained when large and small balls of grinding medium are used in an appropriate formulation. Under the circumstances, since the larger balls contribute to the grinding at the beginning thereof and the smaller balls contribute the grinding at the end thereof, the grinding can be carried out in a very efficient way. However it should be noted that the factor to determine the feeding rate of the fed material is a discharging rate of the ground product from the net member 16 at the end of grinding (see Experiment 6).

EXPERIMENT 1

Ultrafine Grinding of Limestone

Figure 2:
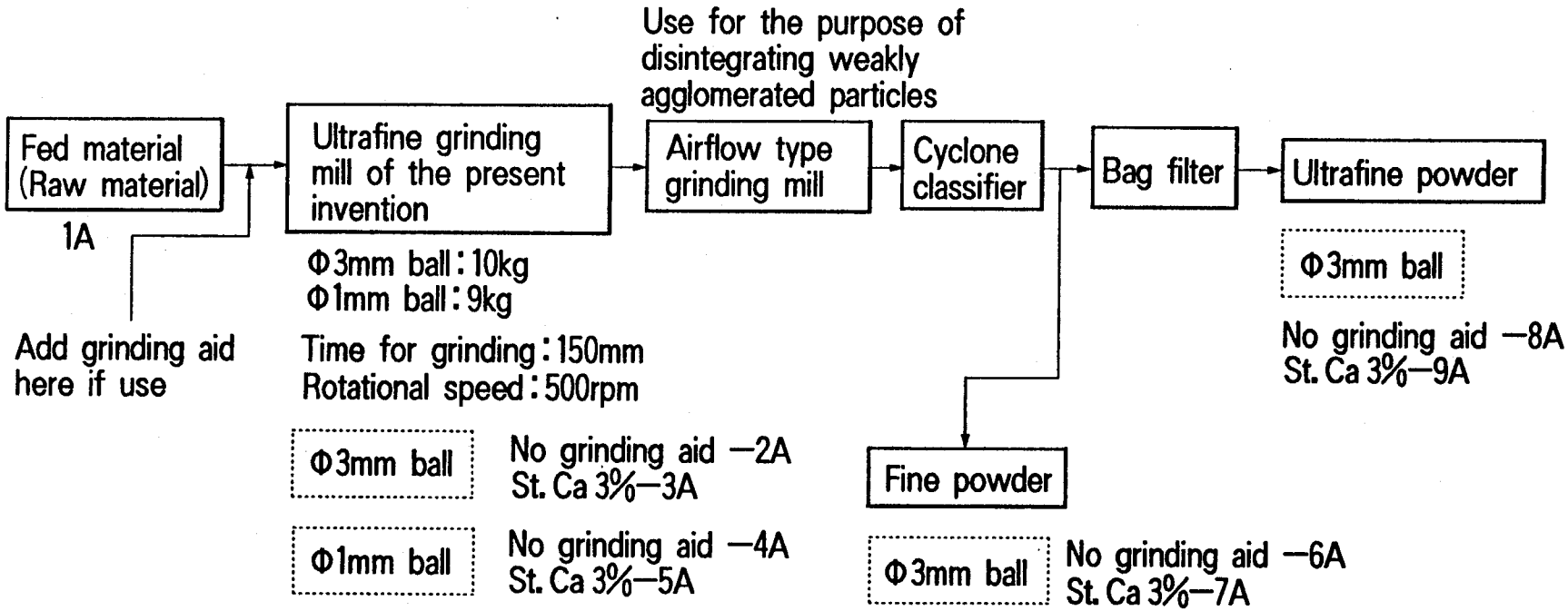
FIG. 2 is a flow chart of ultrafine grinding of limestone in Experiment 1.

As shown in FIG. 2, this experiment was carried out by using the ultrafine grinding mill of the present invention (FIG. 1) in combination with an airflow type grinding mill and a classifier. The preparation of the fed material was carried out by grinding ore of raw material in a dry process by using a M-2 type pin mill (manufactured by NARA KIKAI). The particle size distribution in each step is shown in Tables 1 and 2. Calcium stearate was used as grinding aid. Each value shown as percentage (%) in FIG. 2 means a weight%. The work done per unit weight was 25 kWh/kg.

As can be seen in Tables 1 and 2, the ground product obtained includes about 90% particles of which particle size being less than 3.0 μm in either a case using 3% calcium stearate as grinding aid or a case not using any grinding aid, if used balls of 3 mm diameter as grinding medium. When using balls of 1 mm diameter, the ground product obtained includes about 93.3% particles of which particle size being less than 3.0 μm when not used any grinding aid and includes about 95.2% particles of which particle size being less than 3.0 μm when used 3% calcium stearate as grinding aid. Thus the grinding was most effectively carried out in all experiments of the present invention.

These ground products was once disintegrated by an airflow type grinding mill STJ-200 (manufactured by SEISHIN KIGYOU), classified by using a cyclone, and then collected by using a bag filter. The obtained particles after these treatments became less than 2 μm. The electron microscope photograph shows that configuration of each particle is substantially spherical and thus good results were obtained. The recovery ratio (%) of the ultrafine particles less than 2 μm shown in "8A" and "9A" was more than 95%.

Figure 3:
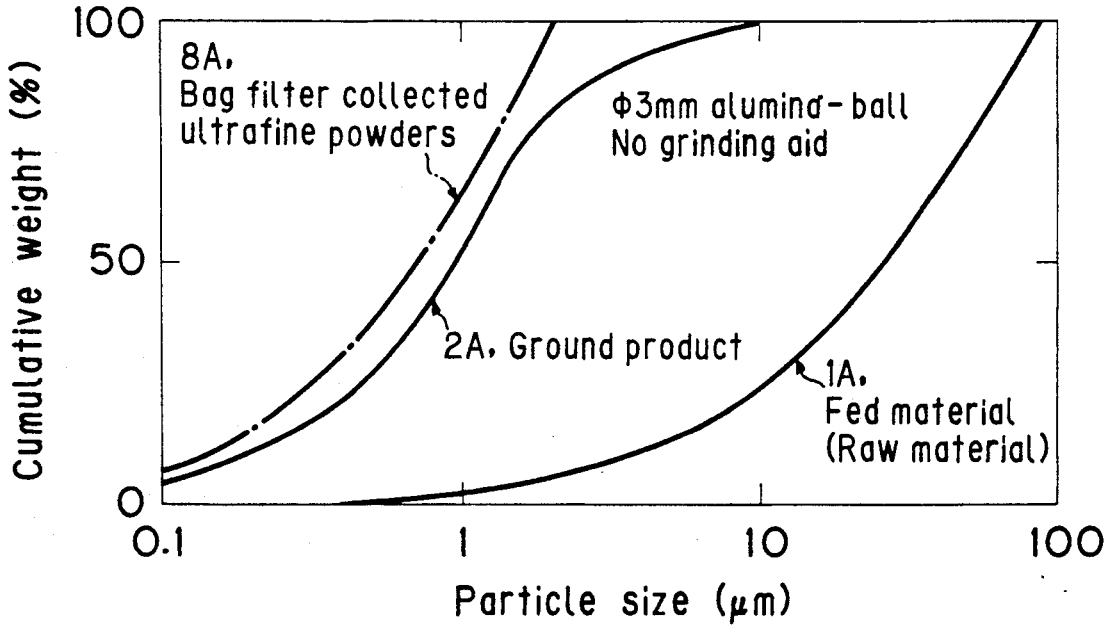
FIG. 3 is a graph showing particle size distributions 1A, 2A and 8A in Tables 1 and 2.
Figure 4:
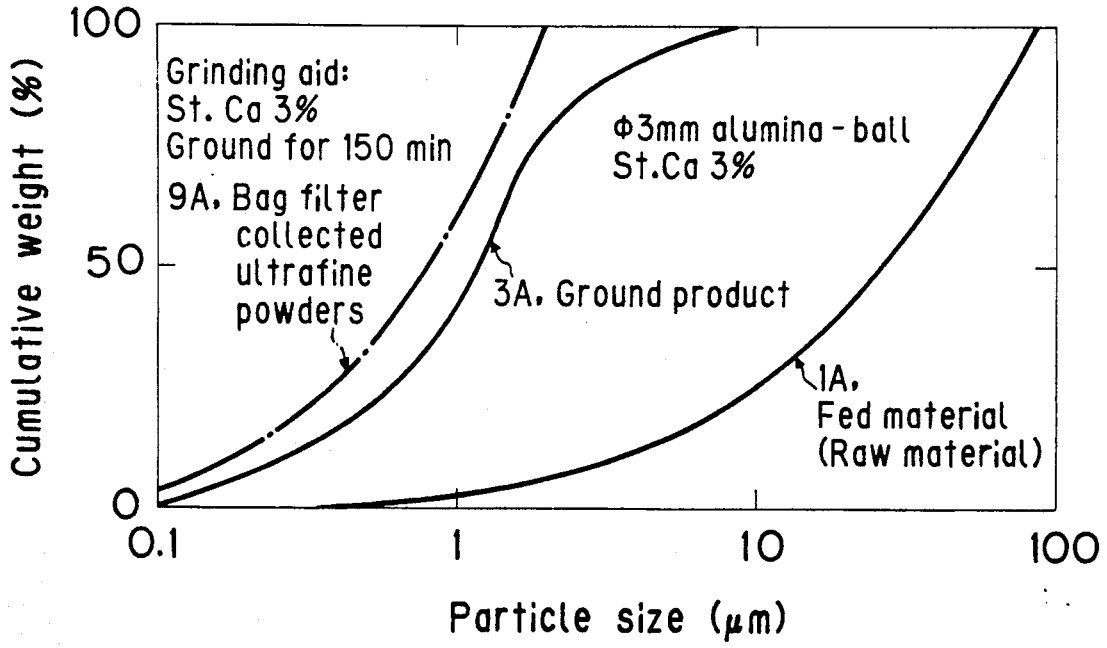
FIG. 4 is a graph showing particle size distributions 1A, 3A and 9A in Tables 1 and 2.
Figure 5:
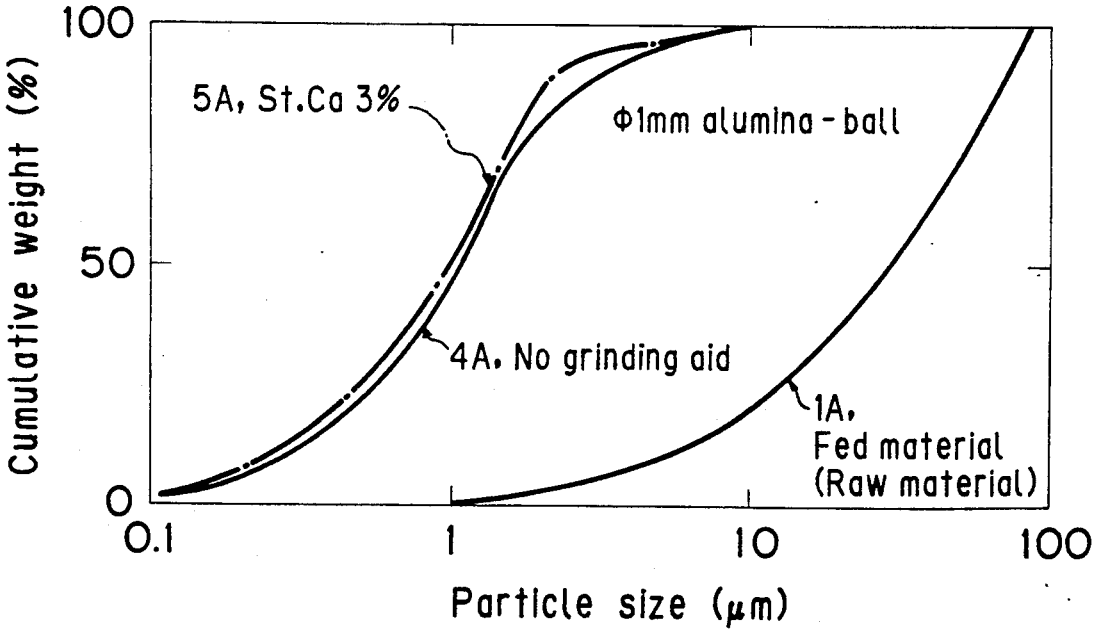
FIG. 5 is a graph showing particle size distributions 1A, 3A and 9A in Tables 1 and 2.

FIG. 3 is a graph showing particle size distributions 1A, 2A and 8A in Tables 1 and 2, FIG. 4 is a graph showing particle size distributions 1A, 3A and 9A in Tables 1 and 2, and FIG. 5 is a graph showing particle size distributions 1A, 4A and 5A in Tables 1 and 2.

EXPERIMENT 2

Experiment Relating to the Cooling Effect of the Grinding Chamber Using Limestone and Talc Using limes tone and talc under the conditions shown in Table 3, an experiment was carried out relating to the influences on the grinding effects by the cooling of the grinding chamber (i.e. the cylindrical housing 2). Two cooling methods were used, one of which was to circulate city water between the walls of the cylindrical housing 2 and the other of which was to directly throw into the grinding chamber crushed pieces of dry ice of about 10 mm twice (i.e. at the beginning and the middle of the grinding course) each time with about 300 cc (apparent volume) of the crushed dry ice.

In the directly throw-in method, the grinding effect was somewhat obstructed due to the vaporization of dry ice with the lapse of time and the presence of dry ice pieces in the grinding chamber. In addition unevenness of temperature distribution was increased. In general a tendency of the particle size distribution shifting toward coarser particles is remarkable in the dry ice throw-in method and superior grinding effect was obtained by the city water cooling method in either a case of limestone (ground without any grinding aid) or a case of talc (ground using 3% St. Ca).

Although many reasons can be supposed as to why the dry ice throw-in method could not obtain a good result, it is considered that temperature rise necessary for causing a effective action by the grinding aid is suppressed due to the change of moisture caused by temperature drop and the melting or vaporization of calcium stearate (St. Ca). At all events it is considered that the exceeding cooling of the grinding chamber will suppress the grinding effect and therefore it is preferable to keep the temperature within the grinding chamber (i.e. the temperature on the inner wall of the cylindrical housing 2) at maximum 100°~130° C.

According to the electron microscope photographs of the ground product, each particle forming the ground product has a spherical configuration rounded from the particle forming the raw material.

Figure 6:
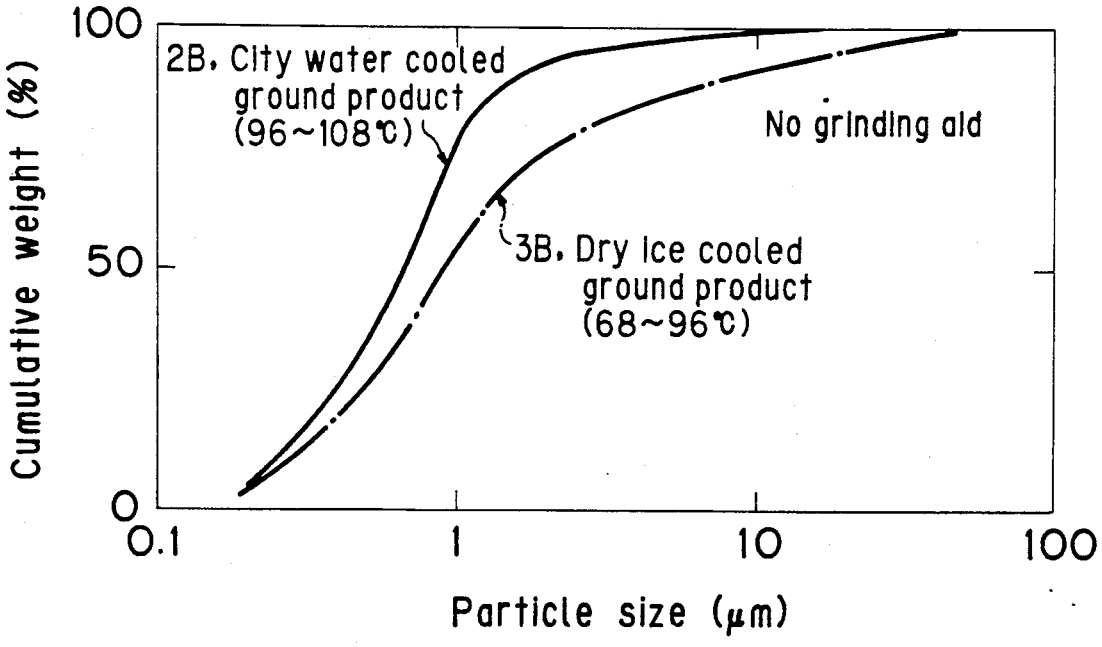
FIG. 6 is a graph showing particle size distributions 2B and B in Table 3 of ground products limestone when compulsorily cooled by using city water and dry ice.

FIG. 6 is a graph showing the particle size distributions 2B and 3B in Table 3 when cooled respectively by the city water and the dry ice.

EXPERIMENT 3

The Effects of the Grinding Aid in the Ultrafine Grindings of Limestone and Talc An experiment was carried out for examining the effects of the grinding aid in the ultrafine grindings of limestone and talc. Three kinds of grinding aids such as calcium stearate (St. Ca), triethanolamine (TEA) and polyethylene glycol-300 (PEG-300) were used, which are considered effective for grinding limestone. Under the room temperature only calcium stearate (St. Ca) exhibits solid powder and the two others exhibit liquid. Tables 4 and 5 show the results of experiments of ultrafine grinding in both cases of with and without the grinding aid. Table 4 shows the results of ultrafine grinding of limestone and Table 5 shows that of talc.

In a case of grinding limestone shown in Table 4, polyethylene glycol-300 was not suited for the ultrafine grinding mill of the present invention since it tends to shave off the surfaces of the grinding chamber 2 and the stainless steel screen 16 and the iron pieces shaved off therefrom are mingled into the ground product.

Calcium stearate, as shown in Table 4, exhibits a good result for the formation of ultrafine ground product of which particle having a particle size less than 1.0 μm. However, regarding to the formation of ultrafine ground product of which particle having a particle size more than 1.5 μm, better results were obtained without using calcium stearate. This would be because that calcium stearate acts on the surface of the particle of limestone and thus the surface thereof becomes slippery.

With respect to the effect of the grinding aid in grinding talc shown in Table 5, it exhibits a tendency contrary to that shown in Table 4 and calcium stearate exhibits excellent effects of grinding aid on talc. This would be because that calcium stearate has an effect promoting the delamination action between talc particles.

With respect to the effect of triethanolamine when used as a grinding aid for limestone, it is inferior to the effect of calcium stearate on grinding limestone. This would be because that since triethanolamine acts on the surface of a particle and thus the mutually slippery effect between particles are further enhanced, the particles rapidly passed through the grinding chamber and therefore sufficient grinding was not applied to the particles.

The experiment of grinding limestone shown in Table 1 proves that the grinding using alumina-balls of 1 mm diameter is generally superior to that using alumina-balls of 3 mm diameter either in a case without using any grinding aid or a case with using calcium stearate. This would be because that the frequency of grinding action on the fed material using alumina-balls of 1 mm diameter is larger than that using alumina-balls of 3 mm diameter.

Figure 7:
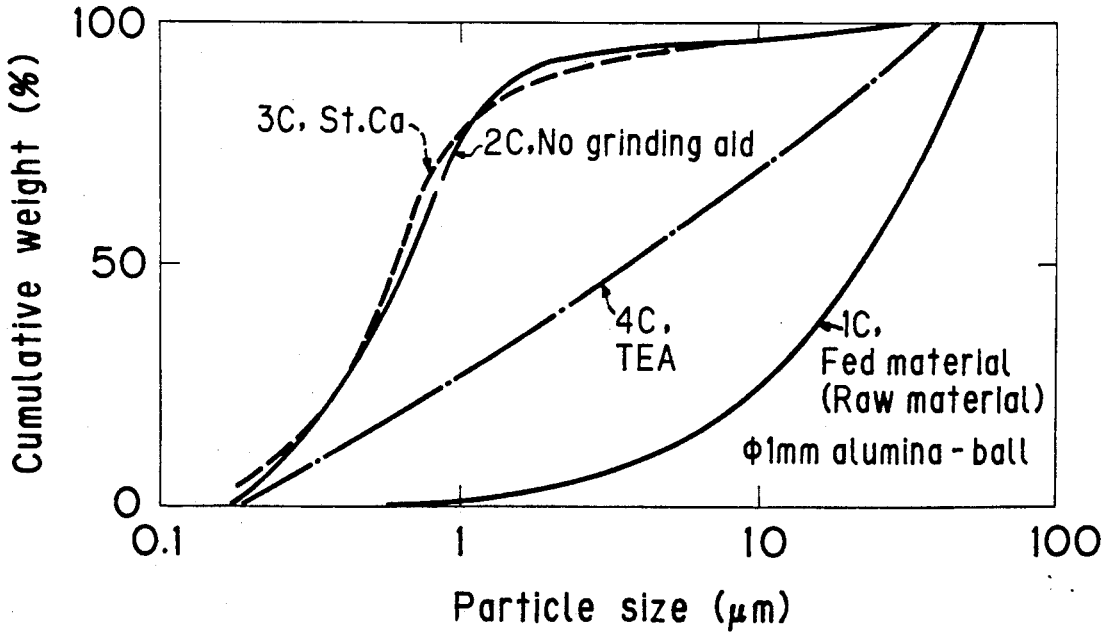
FIG. 7 is a graph showing particle size distributions 1C, 2C, C and 4C of fed material and ground product in Table 4 as to when ground the fed material of limestone not using any grinding aid as well as when ground using calcium stearate and triethanolamine.

FIG. 7 shows particle size distributions in Table 4 with using alumina-balls of 1 mm diameter both in a case of grinding limestone without using any grinding aid and in a case of grinding limestone using calcium stearate and triethanolamine as grinding aids.

Figure 8:
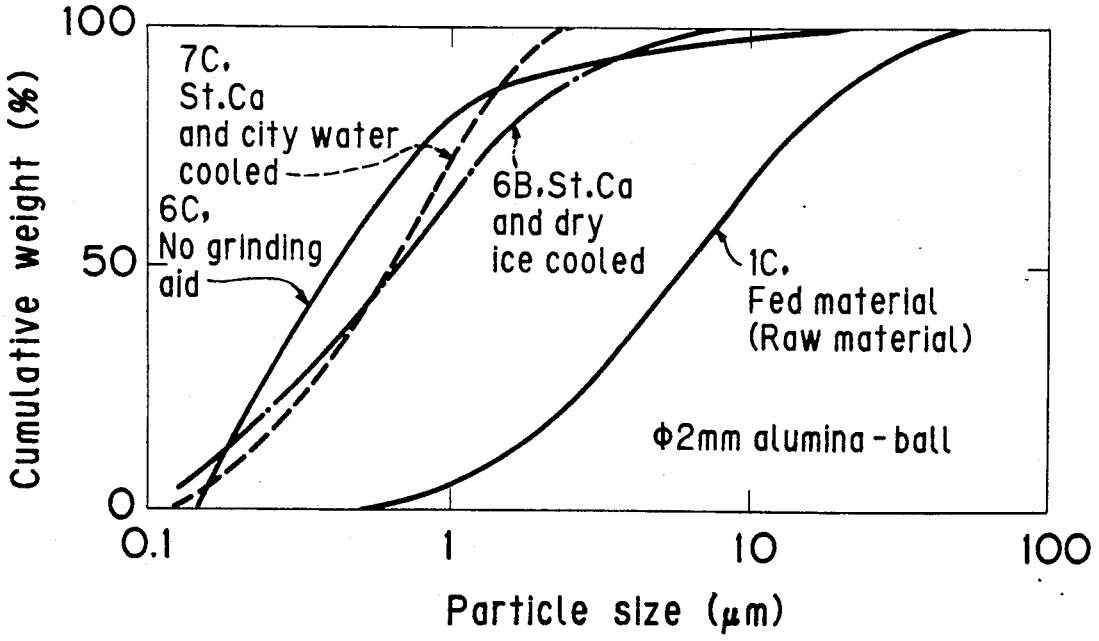
FIG. 8 is a graph showing particle size distributions 6B, 1C, 6C and 7C of fed material and ground product in Tables 3 and 5 when examined the cooling effect of the grinding chamber and the effect of the grinding aid using alumina-balls each having a 2 mm diameter.

FIG. 8 shows particle size distributions in Tables 3 and 5 as to the fed material when ultrafine grinding talc with the use of alumina-balls of 2 mm diameter, as to the ground product ground without using any grinding aid, as to the ground product ground with cooled by city water and with the use of calcium stearate as a grinding aid, and as to the ground product ground with cooled by dry ice.

Comparing the fed material of talc with the ground product 5B in Table 3 by using electron microscope photographs, it is shown that each fed material of talc is flattened without any corner and exhibits a disc shape.

EXPERIMENT 4

Ultrafine Grinding of Kaolin

An experiment of ultrafine grinding of kaolin was carried out by using the ultrafine grinding mill of the present invention and the particle size distribution obtained is shown in Table 6. The fed material of kaolin has been sufficiently ground and therefore the potential cracks included in each particle and contribute to breakage are almost exhausted. This is one example that the progressive rate of ultrafine grinding is still slow even if used the ultrafine grinding mill of the present invention.

Figure 9:
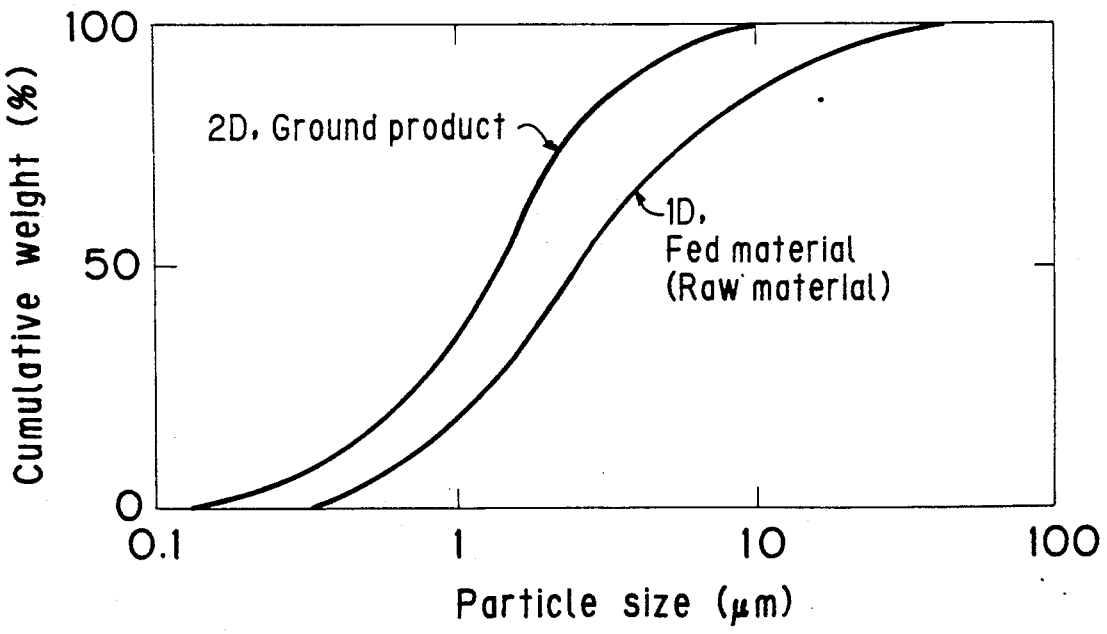
FIG. 9 is a graph showing particle size distributions 1D and 2D in Table 6 of fed material and ground product of kaolin.

However somewhat progress of grinding can be found since the ground product in which particles less than 10 μm occupy 99.3% contrary to the fact that particles less than 50 μm occupy 99.5% in the fed material. Observing the configuration of the particle of the ground product, the particle exhibits a flattened disc without any corner and thus the configuration control effect according to the ultrafine grinding mill of the present invention can be found therein. FIG. 9 shows particle size distributions in the experiment shown in Table 6.

EXPERIMENT 5

Formulation of Grinding Mediums Having Different Particle Sizes

Figure 10:
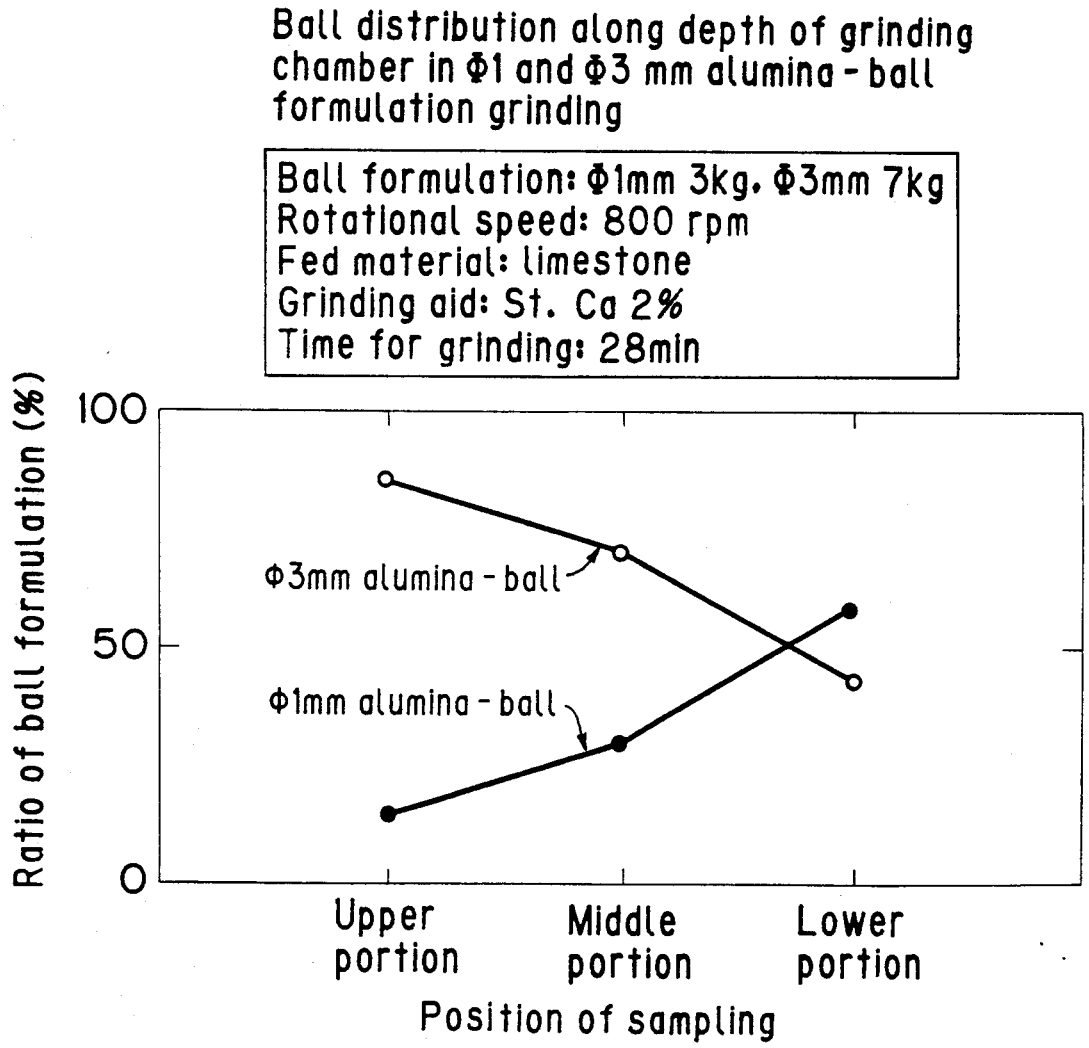
FIG. 10 is a graph showing a distribution of grinding medium along the depth thereof when used a formulation of alumina balls of 1 mm and 3 mm diameters as grinding mediums.

All of the experiments stated above are cases in which ultrafine grindings were carried out using, as grinding mediums, several kinds of balls each having a uniform diameter such as 1 mm, 2 mm and 3 mm. However, in the experiment 5, grinding mediums each having a different diameter are mingled and agitated. FIG. 10 shows a particle size distribution along a depth of the grinding mediums when mingling 3 kg of alumina-balls of 1 mm diameter and 7 kg of allumina-balls of 3 mm diameter and agitating for 28 minutes at 800 rpm with the use of calcium stearate as a grinding medium. The upper portion is occupied by a large amount of large balls of 3 mm diameter and the lower portion is occupied by a large amount of small balls of 1 mm diameter and the middle portion is occupied by large and small balls at a ratio substantially identical to the formulation ratio. The reason of which is as aforementioned and such a ball distribution is very effective for the ultrafine grinding.

EXPERIMENT 6

Influences by Particle Configuration in the Abrasion Test

The configuration of the particle forming the ground product obtained by the ultrafine grinding mill of the present invention is substantially spherical and thus has a feature that the abrasion is very small as compared with a particle having an irregular configuration. In order to confirm this fact, abrasion losses of a plastic wire (PW) and a bronze wire (BW) were measured by a NIPPON FILCON type abrasion tester. The results of which are shown in Table 7. Comparing a slurry of limestone ultrafine particles having irregular configuration produced by the dry process with a slurry of the ground product produced by the ultrafine grinding mill of the present invention (both slurries have substantially same particle size distribution), the abrasion loss of the slurry (plastic wire) of the ground product produced by the ultrafine grinding mill of the present invention corresponds to about 33% of that of the slurry of limestone ultrafine particles having irregular configuration and the abrasion loss of the slurry (bronze wire) of the ground product produced by the ultrafine grinding mill of the present invention corresponds to about 27% of that of the slurry of limestone ultrafine particles. The effect of spheroidization is thus clearly proved.

According to the present invention it is possible to prevent the ground product each particle having a new surface rich in activity from a long time residence in the grinding chamber, to eliminate the chance of being agglomerated due to collision of the grinding medium, and to effectively carry out the ultrafine grinding. Also according to the present invention the ground product is formed by particles each having a spherical configuration. Thus the ground product produced by the present invention is very useful for the packing material of plastic molded members and plastic films and can reduce the high shear viscosity when used as coating material for papermaking and also improve the water retention. Furthermore when used as the internal additive for papermaking, it is possible to remarkably reduce the wire abrasion. Accordingly it is possible to produce the ground product which can improve the accuracy of the interfacial control, viscosity and abrasion resistance and also can be useful for wide fields of powder industries such as manufacturings of raw materials for fine ceramics, pigments and cosmetics.

TABLE 1

Particle size distribution of ultrafine ground product of limestone

| | | Limestone | | | | |
|---|---|---|---|---|---|---|
| | | Fed material 1A | 2A | 3A | 4A | 5A |
| Medium Class | | — | 3 mm alumina-balls | 3 mm alumina-balls | 1 mm alumina-balls | 1 mm alumina-balls |
| Amount of usage, kg | | — | 10.0 | 10.0 | 9.0 | 9.0 |
| Cooling condition of grinding chamber | | — | City water | City water | City water | City water |
| Temperature within grinding chamber (by thermolabel, °C.) | | — | 105 | 105 | 105 | 105 |
| Grinding time, min | | — | 150 | 150 | 150 | 150 |
| Velocity of blades, m/s | | — | 4.58 | 4.58 | 4.58 | 4.58 |
| Grinding aid | | — | Not use | St.Ca 3% | Not use | St.Ca 3% |
| Fed material feeding rate, g/min | | — | 33.3 | 33.3 | 26.7 | 26.7 |
| Partical size distribution, % | −192.0μ | 100.0 | 100.0 | 100.0 | 100.0 | 100.0 |
| | −128.0μ | 99.6 | 100.0 | 100.0 | 100.0 | 100.0 |
| | −96.0μ | 97.2 | 100.0 | 100.0 | 100.0 | 100.0 |
| | −64.0μ | 84.9 | 100.0 | 100.0 | 100.0 | 100.0 |
| | −48.0μ | 74.6 | 100.0 | 100.0 | 100.0 | 100.0 |
| | −32.0μ | 55.0 | 100.0 | 100.0 | 99.1 | 100.0 |
| | −24.0μ | 43.7 | 100.0 | 100.0 | 99.1 | 100.0 |
| | −16.0μ | 30.6 | 100.0 | 100.0 | 99.1 | 100.0 |
| | −12.0μ | 23.8 | 99.4 | 99.5 | 98.9 | 99.1 |
| | −8.0μ | 17.7 | 99.4 | 99.5 | 98.9 | 99.1 |
| | −6.0μ | 13.5 | 98.2 | 98.5 | 98.3 | 98.6 |
| | −4.0μ | 9.8 | 93.7 | 94.8 | 94.7 | 95.2 |
| | −3.0μ | 7.4 | 90.4 | 90.7 | 93.3 | 95.2 |
| | −2.0μ | 4.9 | 82.6 | 78.3 | 85.1 | 91.8 |
| | −1.5μ | 3.2 | 66.0 | 57.6 | 65.3 | 73.1 |
| | −1.0μ | 1.9 | 50.2 | 40.0 | 46.7 | 53.5 |
| | −0.8μ | 1.2 | 41.1 | 32.5 | 37.9 | 43.7 |
| | −0.6μ | 0.7 | 31.0 | 24.4 | 28.2 | 32.6 |
| | −0.4μ | 0.3 | 20.2 | 15.8 | 18.0 | 20.7 |
| | −0.2μ | 0.0 | 9.2 | 7.2 | 7.9 | 8.8 |
| | −0.1μ | 0.0 | 4.0 | 3.2 | 3.3 | 3.6 |
| Average Particle size, μ | | 28.5 | 1.00 | 1.28 | 1.09 | 0.93 |
| Specific surface area, $m^2/g$ | | 2.519 | 4.995 | 4.209 | 4.557 | 5.009 |

*Note: Instrument used for measuring particle size distribution; PRO-7000S (manufactured by SEISIN KIGYOU)

TABLE 2

Particle size distribution of ultrafine ground product and classified ground product of limestone

| | | Limestone | | | | |
|---|---|---|---|---|---|---|
| | | Fed material 1A | 6A Cyclone collected 2A particles | 7A Cyclone collected 3A particles | 8A Bag filter collected 2A particles | 9A Bag filter collected 3A particles |
| Medium Class | | — | 3mm alumina-balls | 3mm alumina-balls | 1mm alumina-balls | 1 mm alumina-balls |
| Amount of usage, kg | | — | 10.0 | 10.0 | 9.0 | 9.0 |
| Cooling condition of grinding chamber | | — | City water | City water | City water | City water |
| Temperature within grinding chamber (by thermolabel, °C.) | | — | 105 | 105 | 105 | 105 |
| Grinding time, min | | — | 150 | 150 | 150 | 150 |
| Velocity of blades, m/s | | — | 4.58 | 4.58 | 4.58 | 4.58 |
| Grinding aid | | — | Not use | St.Ca 3% | Not use | St.Ca 3% |
| Fed material feeding rate, g/min | | — | 33.3 | 33.3 | 26.7 | 26.7 |
| Partical size distribution, % | −192.0μ | 100.0 | 100.0 | 100.0 | 100.0 | 100.0 |
| | −128.0μ | 99.6 | 100.0 | 100.0 | 100.0 | 100.0 |
| | −96.0μ | 97.2 | 100.0 | 100.0 | 100.0 | 100.0 |
| | −64.0μ | 84.8 | 100.0 | 100.0 | 100.0 | 100.0 |
| | −48.0μ | 74.6 | 100.0 | 100.0 | 100.0 | 100.0 |
| | −32.0μ | 55.0 | 100.0 | 100.0 | 100.0 | 100.0 |
| | −24.0μ | 43.7 | 100.0 | 100.0 | 100.0 | 100.0 |
| | −16.0μ | 30.6 | 100.0 | 100.0 | 100.0 | 100.0 |
| | −12.0μ | 23.8 | 100.0 | 100.0 | 100.0 | 100.0 |
| | −8.0μ | 17.7 | 100.0 | 100.0 | 100.0 | 100.0 |
| | −6.0μ | 13.5 | 100.0 | 100.0 | 100.0 | 100.0 |

TABLE 2-continued

| Particle size distribution of ultrafine ground product and classified ground product of limestone | | | | | |
|---|---|---|---|---|---|
| | Limestone | | | | |
| | Fed material 1A | 6A Cyclone collected 2A particles | 7A Cyclone collected 3A particles | 8A Bag filter collected 2A particles | 9A Bag filter collected 3A particles |
| −4.0μ | 9.8 | 96.7 | 98.9 | 100.0 | 100.0 |
| −3.0μ | 7.4 | 89.1 | 89.2 | 100.0 | 100.0 |
| −2.0μ | 4.9 | 75.7 | 65.7 | 100.0 | 100.0 |
| −1.5μ | 3.2 | 53.6 | 37.2 | 84.5 | 81.3 |
| −1.0μ | 1.9 | 35.0 | 18.9 | 64.3 | 59.9 |
| −0.8μ | 1.2 | 27.4 | 12.0 | 55.9 | 50.3 |
| −0.6μ | 0.7 | 19.7 | 6.6 | 44.6 | 38.1 |
| −0.4μ | 0.3 | 12.0 | 2.7 | 30.3 | 23.9 |
| −0.2μ | 0.0 | 4.9 | 0.6 | 13.0 | 9.6 |
| −0.1μ | 0.0 | 2.0 | 0.1 | 5.9 | 3.6 |
| Average Particle size, μ | 28.5 | 1.40 | 1.70 | 0.70 | 0.80 |
| Specific surface area, $m^2/g$ | 2.519 | 3.412 | 1.752 | 6.713 | 5.422 |

Note: Instrument used for measuring particle size distribution; PRO-7000S (manufactured by SEISIN KIGYOU)

TABLE 3

| Cooling effect of grinding chamber | | | | | | | |
|---|---|---|---|---|---|---|---|
| | | Limestone | | | Talc | | |
| | | Fed medical 1A | 2B | 3B | Fed medical 4B | 5B | 6B |
| Medium | Class | — | 1 mm alumina-balls | 1 mm alumina-balls | — | 2 mm alumina-balls | 2 mm alumina-balls |
| | Amount of usage, kg | — | 9.0 | 9.0 | — | 10.0 | 10.0 |
| Cooling condition of grinding chamber | | — | City water | Dry ice | — | City water | Dry Ice |
| Temperature within grinding chamber (by thermolabel, °C.) | | — | 96–108 | 68–96 | — | 41–63 | 31–35 |
| Grinding time, min | | — | 150 | 150 | — | 150 | 150 |
| Velocity of blades, m/s | | — | 5.1 | 5.1 | — | 3.06 | 3.06 |
| Grinding aid | | — | Not use | Not use | — | St.Ca 3% | St.Ca 3% |
| Fed material feed rate, g/min | | — | 26.7 | 26.7 | — | 20.0 | 20.0 |
| Partical size distribution. % | −60.0μ | 100.0 | 100.0 | 100.0 | 100.0 | 100.0 | 100.0 |
| | −50.0μ | 93.7 | 99.9 | 99.5 | 98.9 | 100.0 | 100.0 |
| | −40.0μ | 82.2 | 99.7 | 98.6 | 96.8 | 100.0 | 100.0 |
| | −30.0μ | 65.3 | 99.4 | 97.2 | 93.4 | 100.0 | 100.0 |
| | −20.0μ | 47.9 | 98.7 | 94.3 | 86.6 | 100.0 | 100.0 |
| | −15.0μ | 37.7 | 98.1 | 91.6 | 80.5 | 100.0 | 100.0 |
| | −10.0μ | 24.1 | 97.6 | 87.6 | 65.8 | 100.0 | 100.0 |
| | −8.0μ | 18.7 | 97.6 | 86.3 | 57.2 | 100.0 | 100.0 |
| | −6.0μ | 13.1 | 96.6 | 83.3 | 46.8 | 100.0 | 100.0 |
| | −5.0μ | 10.2 | 96.6 | 80.4 | 40.1 | 100.0 | 100.0 |
| | −4.0μ | 8.1 | 96.6 | 80.4 | 33.0 | 100.0 | 93.6 |
| | −3.0μ | 5.8 | 96.6 | 80.4 | 25.0 | 100.0 | 89.3 |
| | −2.0μ | 3.6 | 96.0 | 75.1 | 17.8 | 98.6 | 85.9 |
| | −1.5μ | 2.1 | 92.2 | 67.1 | 11.7 | 89.8 | 79.0 |
| | −1.0μ | 0.9 | 73.8 | 51.7 | 5.3 | 70.5 | 64.3 |
| | −0.8μ | 0.5 | 60.7 | 42.4 | 3.0 | 59.4 | 55.6 |
| | −0.6μ | 0.2 | 43.6 | 31.1 | 1.3 | 45.7 | 44.6 |
| | −0.5μ | 0.1 | 33.7 | 24.6 | 0.7 | 37.9 | 38.3 |
| | −0.4μ | 0.0 | 23.5 | 17.6 | 0.2 | 29.6 | 31.4 |
| | −0.3μ | 0.0 | 13.3 | 10.2 | 0.0 | 20.8 | 24.3 |
| | −0.2μ | 0.0 | 4.5 | 2.8 | 0.0 | 12.0 | 15.8 |
| Average Particle size, μ | | 21.221 | 0.674 | 0.964 | 6.616 | 0.662 | 0.699 |
| Specific surface area, $m^2/g$ | | 0.229 | 4.582 | 3.407 | 0.647 | 5.903 | 6.312 |

*Note: Instrument used for measuring particle size distribution; SA-CP4L (manufactured by SHIMADZU SEISAKUSHO)

TABLE 4

| No. 1: Grinding Effect due to addition of grinding aid | | | | | |
|---|---|---|---|---|---|
| | | Limestone | | | |
| | | Fed material 1C | 2C | 3C | 4C | 5C |
| Medium | Class | — | 1 mm alumina- | 1 mm alumina- | 1 mm alumina- | 1 mm alumina- |

TABLE 4-continued

No. 1: Grinding Effect due to addition of grinding aid

| | | Limestone | | | | |
|---|---|---|---|---|---|---|
| | | Fed material 1C | 2C | 3C | 4C | 5C |
| | | | balls | balls | balls | balls |
| Amount of usage, kg | | — | 9.0 | 9.0 | 9.0 | 9.0 |
| Cooling condition of grinding chamber | | — | City water | City water | City water | City water |
| Temperature within grinding chamber, °C. | | — | 96–108 | 108–117 | 105–115 | — |
| Grinding time, min | | — | 150 | 150 | 150 | 30 |
| Velocity of blades, m/s | | — | 5.1 | 5.1 | 5.1 | 5.1 |
| Grinding aid | | — | Not use | St.Ca 3% | TEA 3% | PEG-300 3% |
| Fed material feeding rate, g/min | | — | 26.7 | 26.7 | 26.7 | 26.7 |
| Partical size distribution, % | −60.0μ | 100.0 | 100.0 | 100.0 | 100.0 | Iron shaved off from inner wall and wedge screen wire was mingled with fed material and grinding medium. With the result of which balls of grinding medium were dis-colored. |
| | −50.0μ | 93.7 | 99.9 | 99.4 | 98.5 | |
| | −40.0μ | 82.2 | 99.7 | 99.1 | 95.8 | |
| | −30.0μ | 65.3 | 99.4 | 98.8 | 91.3 | |
| | −20.0μ | 47.9 | 98.7 | 98.2 | 82.4 | |
| | −15.0μ | 37.7 | 98.1 | 98.0 | 74.5 | |
| | −10.0μ | 24.1 | 97.6 | 97.7 | 67.8 | |
| | −8.0μ | 18.7 | 97.6 | 97.1 | 64.3 | |
| | −6.0μ | 13.1 | 96.6 | 96.3 | 62.6 | |
| | −5.0μ | 10.2 | 96.6 | 95.7 | 60.7 | |
| | −4.0μ | 8.1 | 96.6 | 94.8 | 52.3 | |
| | −3.0μ | 5.8 | 96.6 | 93.4 | 47.7 | |
| | −2.0μ | 3.6 | 96.0 | 90.2 | 43.5 | |
| | −1.5μ | 2.1 | 92.2 | 87.0 | 35.3 | |
| | −1.0μ | 0.9 | 73.8 | 78.7 | 24.5 | |
| | −0.8μ | 0.5 | 60.7 | 69.0 | 19.9 | |
| | −0.6μ | 0.2 | 43.6 | 49.9 | 14.9 | |
| | −0.5μ | 0.1 | 33.7 | 37.3 | 12.2 | |
| | −0.4μ | 0.0 | 23.5 | 24.3 | 9.3 | |
| | −0.3μ | 0.0 | 13.3 | 13.0 | 6.1 | |
| | −0.2μ | 0.0 | 4.5 | 4.1 | 2.8 | |
| Average Particle size, μ | | 21.221 | 0.674 | 0.601 | 3.499 | — |
| Specific surface area, $m^2/g$ | | 0.229 | 4.582 | 4.655 | 2.099 | — |

*Note Instrument used for measuring particle size distribution; SA-CP4L (manufactured by SHIMADZU SEISAKUSYO)

TABLE 5

No. 2: Grinding Effect due to addition of grinding aid

| | | Talc | | |
|---|---|---|---|---|
| | | Fed material 1C | 6C | 7C |
| Medium Class | | — | 2 mm alumina-balls | 2 mm alumina-balls |
| Amount of usage, kg | | — | 10.0 | 10.0 |
| Cooling condition of grinding chamber | | — | City water | City water |
| Temperature within grinding chamber, °C. | | — | 48–78 | 41–63 |
| Grinding time, min | | — | 150 | 150 |
| Velocity of blades, m/s | | — | 3.06 | 3.06 |
| Grinding aid | | — | Not use | St.Ca 3% |
| Fed material feeding rate, g/min | | — | 20.0 | 20.0 |
| Partical size distribution, % | −60.0μ | 100.0 | 100.0 | 100.0 |
| | −50.0μ | 93.7 | 99.9 | 100.0 |
| | −40.0μ | 82.2 | 99.6 | 100.0 |
| | −30.0μ | 65.3 | 99.2 | 100.0 |
| | −20.0μ | 47.9 | 98.5 | 100.0 |
| | −15.0μ | 37.7 | 97.8 | 100.0 |
| | −10.0μ | 24.1 | 96.8 | 100.0 |
| | −8.0μ | 18.7 | 96.1 | 100.0 |
| | −6.0μ | 13.1 | 95.3 | 100.0 |
| | −5.0μ | 10.2 | 94.7 | 100.0 |
| | −4.0μ | 8.1 | 93.8 | 100.0 |
| | −3.0μ | 5.8 | 92.5 | 100.0 |
| | −2.0μ | 3.6 | 90.1 | 98.6 |
| | −1.5μ | 2.1 | 89.4 | 89.8 |

TABLE 5-continued

No. 2: Grinding Effect due to addition of grinding aid

| | | Talc | | |
|---|---|---|---|---|
| | | Fed material 1C | 6C | 7C |
| | −1.0μ | 0.9 | 82.0 | 70.5 |
| | −0.8μ | 0.5 | 75.6 | 59.4 |
| | −0.6μ | 0.2 | 65.3 | 45.7 |
| | −0.5μ | 0.1 | 57.7 | 37.9 |
| | −0.4μ | 0.0 | 47.6 | 29.6 |
| | −0.3μ | 0.0 | 33.8 | 20.8 |
| | −0.2μ | 0.0 | 15.5 | 12.0 |
| Average Particle size, μ | | 21.221 | 0.424 | 0.662 |
| Specific surface area, $m^2/g$ | | 0.229 | 7.423 | 5.909 |

*Note: Instrument used for measuring particle size distribution; SA-CP4L (manufactured by SHIMADZU SEISAKUSYO)

TABLE 6

Grinding of kaolin

| | Fed material 1D | 2D |
|---|---|---|
| Medium Class | — | 2 mm alumina-balls |
| Amount of usage, kg | — | 8.5 |
| Cooling condition of grinding chamber | — | City water |
| Temperature within grinding chamber, °C. | — | 48–78 |
| Grinding time, min | — | 150 |
| Velocity of blades, m/s | — | 3.06 |

TABLE 6-continued

| | | Grinding of kaolin | |
|---|---|---|---|
| | | Fed material 1D | 2D |
| Grinding aid | | — | Not use |
| Fed material feeding rate, g/min | | — | 20.0 |
| Partical size distribution, % | −60.0μ | 100.0 | 100.0 |
| | −50.0μ | 99.5 | 100.0 |
| | −40.0μ | 98.7 | 99.9 |
| | −30.0μ | 97.3 | 99.8 |
| | −20.0μ | 94.5 | 99.5 |
| | −15.0μ | 92.1 | 99.3 |
| | −10.0μ | 85.5 | 99.3 |
| | −8.0μ | 79.5 | 97.6 |
| | −6.0μ | 73.3 | 94.7 |
| | −5.0μ | 68.2 | 92.5 |
| | −4.0μ | 60.0 | 83.5 |
| | −3.0μ | 51.9 | 77.4 |
| | −2.0μ | 39.4 | 66.1 |
| | −1.5μ | 27.5 | 50.0 |
| | −1.0μ | 13.9 | 30.2 |
| | −0.8μ | 9.3 | 23.3 |
| | −0.6μ | 5.2 | 16.6 |
| | −0.5μ | 3.3 | 13.4 |
| | −0.4μ | 1.7 | 10.2 |
| | −0.3μ | 0.1 | 6.7 |
| | −0.2μ | 0.0 | 2.8 |
| Average Particle size, μ | | 2.848 | 1.499 |
| Specific surface area, $m^2/g$ | | 1.222 | 2.706 |

*Note: Instrument used for measuring particle size distribution: SA-CP4L (manufactured by SHIMADZU SEISAKUSYO)

TABLE 7

| | Results of abrasion comparison | | | |
|---|---|---|---|---|
| | Class | | | |
| | P.W (mg/180 min) | | B.W (mg/180 min) | |
| The number of times | Ground product of irregular configuration particles | Ground product produced by ultrafine grinding mill of the invention | Ground product of irregular configuration particles | Ground product produced by ultrafine grinding mill of the invention |
| 1 | 18.5 | 7.6 | 26.9 | 5.4 |
| 2 | 21.6 | 8.0 | 16.4 | 5.5 |
| 3 | 23.7 | 4.5 | 23.6 | 5.4 |
| 4 | 25.1 | 6.5 | 14.1 | 6.1 |
| 5 | 16.0 | 6.8 | 24.2 | 5.6 |
| 6 | 18.7 | — | 17.4 | — |
| 7 | 16.5 | — | — | — |
| 8 | 21.7 | — | — | — |
| 9 | 23.8 | — | — | — |
| 10 | 20.7 | — | — | — |
| Mean value | 20.6 | 6.7 | 20.4 | 5.6 |

*Note. Method of measurement
Instrument used for measurement: NIPPON FILCON type abrasion tester
1) Rolls: P.W—C
B.W—A
2) Density of sample: 2%
3) Time for test: 180 min

What is claimed is:

1. An ultrafine dry grinding mill comprising:

a vertically-arranged cylindrical housing for containing a bed of grinding medium comprising grinding elements of varying diameters, said housing having a top, a bottom, an inner surface, and a longitudinal central axis;

a screen closing said bottom of said housing, said screen having a mesh size preventing the grinding medium from passing therethrough;

a rotary shaft arranged on said central axis of said housing;

a plurality of stages of agitating blades mounted on and extending radially outward from said rotary shaft for rotation in parallel planes and including an uppermost stage and a lowermost stage, each stage including a plurality of blades, said blades of at least one of said stages being vertically-oriented and said blades of at least one of said stages being inclined relative to said longitudinal central axis of said housing, each of said blades having a tip spaced from said inner surface of said housing to define a gap between said tip and said inner surface at room temperature, and said lowermost stage being spaced from said screen to define a gap between said lowermost stage and said screen at room temperature, said gap between each said tip and said inner surface at room temperature and said gap between said lowermost stage and said screen at room temperature both being not more than two-thirds the smallest diameter of the grinding medium at room temperature.

2. The grinding mill of claim 1, wherein said housing has inner and outer walls, and includes means for circulating cooling water through and between said walls.

3. The grinding mill of claim 1, wherein said screen is stainless steel.

4. The grinding mill of claim 1, wherein said tips of said blades are flexible.

5. The grinding mill of claim 4, wherein said tips are formed of a heat resisting material.

6. The grinding mill of claim 1, wherein said blades of said lowermost stage have a bottom edge, and a flexible member provided at said bottom edge.

7. The grinding mill of claim 6, wherein said flexible members are formed of a heat resisting material.

8. The grinding mill of claim 1, wherein said grinding medium comprises alumina balls.

9. The grinding mill of claim 1, wherein said grinding medium comprises zirconia balls.

* * * * *